US009987735B2

(12) United States Patent
Evatt et al.

(10) Patent No.: US 9,987,735 B2
(45) Date of Patent: Jun. 5, 2018

(54) NAIL SET

(71) Applicant: Techtronic Industries Co. Ltd., Tsuen Wan, New Territories (HK)

(72) Inventors: Thomas Evatt, Six Mile, SC (US); Clinton C. Thackery, Clemson, SC (US)

(73) Assignee: TECHTRONIC INDUSTRIES CO. LTD., Hong Kong (HK)

( * ) Notice: Subject to any disclaimer, the term of this patent is extended or adjusted under 35 U.S.C. 154(b) by 439 days.

(21) Appl. No.: 14/658,662

(22) Filed: Mar. 16, 2015

(65) Prior Publication Data

US 2016/0271777 A1 Sep. 22, 2016

(51) Int. Cl.
*B25C 9/00* (2006.01)

(52) U.S. Cl.
CPC ..... *B25C 9/00* (2013.01)

(58) Field of Classification Search
CPC B25C 3/008; B25C 11/00; B25C 9/00; B25C 1/02; B25C 5/1617
See application file for complete search history.

(56) References Cited

U.S. PATENT DOCUMENTS

| | | | | |
|---|---|---|---|---|
| 722,559 | A | 3/1903 | Bond | |
| 814,020 | A * | 3/1906 | Clifford | B25B 15/007 112/80.03 |
| 1,378,698 | A | 5/1921 | Lindstrom | |
| 1,702,607 | A * | 2/1929 | Jensen | B25C 9/00 81/44 |
| 2,977,838 | A | 4/1961 | Oestereicher | |
| 4,041,558 | A | 8/1977 | Victor | |
| 4,054,237 | A | 10/1977 | Rietveld | |
| 5,123,584 | A | 6/1992 | Harrison | |
| D336,413 | S | 6/1993 | Ebert | |
| 5,450,775 | A | 9/1995 | Kozak | |
| 5,526,723 | A | 6/1996 | Sormunen et al. | |
| D371,302 | S | 7/1996 | Spirer | |

(Continued)

FOREIGN PATENT DOCUMENTS

| | | |
|---|---|---|
| CA | 2228532 | 8/1998 |
| CA | 2489904 | 6/2005 |

(Continued)

OTHER PUBLICATIONS

European Search Report Application No. 16160206 dated Aug. 8, 2016 (1 page).

*Primary Examiner* — Robert Scruggs
(74) *Attorney, Agent, or Firm* — Michael Best & Friedrich LLP

(57) ABSTRACT

A nail set includes an elongated body having a longitudinal axis and a pivot axis. The nail set also includes a tool member supported by the elongated body at the pivot axis. The tool member includes a first end portion having a first punch tool and a second end portion having a second punch tool that is different than the first punch tool. The tool member is selectively rotatable about the pivot axis. The nail set further includes a locking member supported by the elongated body and is movable between a first position, where the locking member engages the tool member to inhibit rotation of the tool member about the pivot axis, and a second position, where the tool member is rotatable relative to the elongated body about the pivot axis.

17 Claims, 12 Drawing Sheets

(56) References Cited

U.S. PATENT DOCUMENTS

| | | | | |
|---|---|---|---|---|
| D398,494 | S | 9/1998 | Bickford et al. | |
| 5,926,885 | A | 7/1999 | Williams | |
| 5,975,815 | A * | 11/1999 | Zierpka | B25B 21/007 279/22 |
| 5,979,913 | A | 11/1999 | Kosik et al. | |
| 6,076,431 | A | 6/2000 | Vasudeva | |
| 6,094,781 | A | 8/2000 | Jansson et al. | |
| 6,128,978 | A | 10/2000 | Richey | |
| 6,295,903 | B1 | 10/2001 | Tipper et al. | |
| 6,397,709 | B1 | 6/2002 | Wall | |
| 6,564,681 | B2 | 5/2003 | Coulter | |
| D493,079 | S | 7/2004 | Fowler | |
| 6,951,153 | B2 | 10/2005 | Berthlaume | |
| D538,129 | S | 3/2007 | Jansson et al. | |
| 7,188,555 | B2 | 3/2007 | Beauchamp | |
| 7,237,987 | B2 * | 7/2007 | Hernandez, Jr. | B23B 31/201 279/14 |
| 7,325,469 | B1 | 2/2008 | Clampitt, Jr. et al. | |
| D575,128 | S | 8/2008 | Clampitt, Jr. et al. | |
| D575,129 | S | 8/2008 | Clampitt, Jr. et al. | |
| D575,611 | S | 8/2008 | Clampitt, Jr. et al. | |
| D575,612 | S | 8/2008 | Clampitt, Jr. et al. | |
| 8,359,950 | B2 | 1/2013 | Lombardi | |
| 8,590,434 | B2 | 11/2013 | Lai | |
| 8,752,456 | B1 | 6/2014 | Turnbo | |
| 8,857,300 | B2 | 10/2014 | Lai | |
| 8,870,078 | B2 | 10/2014 | Webb et al. | |
| 8,925,429 | B2 | 1/2015 | Johnson et al. | |
| 2006/0229133 | A1 | 10/2006 | Lin | |
| 2007/0187452 | A1 | 8/2007 | Budzisz | |
| 2008/0041193 | A1 * | 2/2008 | Baker | B25B 13/06 81/124.6 |
| 2009/0044664 | A1 | 2/2009 | Geisler et al. | |
| 2010/0132530 | A1 * | 6/2010 | Chen | B21D 28/34 83/698.91 |
| 2011/0100664 | A1 | 5/2011 | Lin | |
| 2013/0118322 | A1 | 5/2013 | Seber et al. | |
| 2014/0290448 | A1 * | 10/2014 | Wen | B25B 15/00 81/440 |

FOREIGN PATENT DOCUMENTS

| | | |
|---|---|---|
| CA | 2582532 | 4/2008 |
| CA | 2718256 | 4/2011 |
| DE | 1266274 | 4/1968 |
| EP | 1283092 | 2/2003 |
| EP | 1731774 | 12/2006 |
| EP | 2036633 | 3/2009 |

* cited by examiner

NAIL SET

FIELD OF THE INVENTION

The present invention relates to nail sets and, more particularly, to nail sets having multiple punch tools of different gauges.

BACKGROUND OF THE INVENTION

Nail sets are typically used in woodworking for driving a nail that extends above a surface of a workpiece below the surface of the workpiece, resulting in a countersunk nail. Different size nail heads may require different sized punch tools to properly countersink the nails.

SUMMARY OF THE INVENTION

In one embodiment, the invention provides a nail set that includes an elongated body having a longitudinal axis and a pivot axis. The nail set also includes a tool member supported by the elongated body at the pivot axis. The tool member includes a first end portion having a first punch tool and a second end portion having a second punch tool that is different from the first punch tool. The tool member is selectively rotatable about the pivot axis. The nail set further includes a locking member supported by the elongated body and movable between a first position, where the locking member engages the tool member to inhibit rotation of the tool member about the pivot axis, and a second position, where the tool member is rotatable relative to the elongated body about the pivot axis.

In another embodiment, the invention provides a nail set that includes an elongated body having a longitudinal axis, a pivot axis, a first end, a second end, and a tool slot extending along the longitudinal axis from the first end toward the second end. The nail set also includes a pin coupled to the first end of the elongated body. The pin defines a pivot axis. The nail set further includes a tool member supported by the pin and at least partially received in the tool slot of the elongated body. The tool member includes a first end portion having a first punch tool, and a second end portion having a second punch tool that is different than the first punch tool. The nail set also includes locking member supported at the second end of the elongated body. The locking member includes a striking surface and a generally cylindrical shaft extending into the elongated body. The locking member is movable relative to the elongated body between a first position, where the generally cylindrical shaft engages the tool member to inhibit rotation of the tool member about the pivot axis, and a second position, where the generally cylindrical shaft is spaced apart from the tool member and the tool member is rotatable relative the elongated body about the pivot axis.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
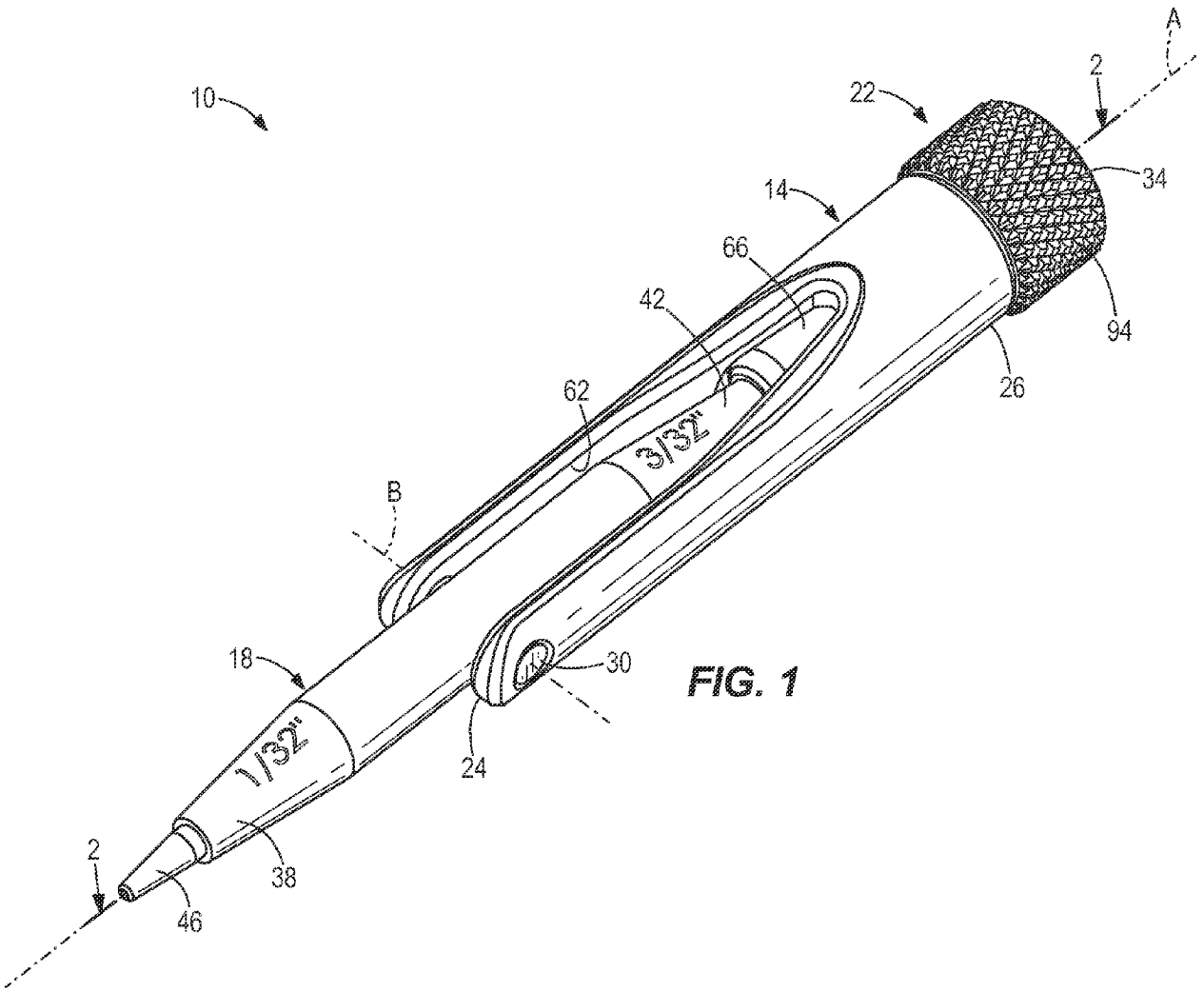
FIG. 1 is a perspective view of a nail set in accordance with an embodiment of the invention.

FIG. 1 illustrates a nail set 10 including an elongated body 14, a tool member 18, and a locking member 22. The elongated body 14 has a first end 24 and a second end 26. The elongated body 14 also has a longitudinal axis A that extends through the first end 24 and the second end 26. The elongated body 14 further has a pivot axis B that is located at the first end 24. In the illustrated embodiment, the pivot axis B is substantially perpendicular to the longitudinal axis A. The tool member 18 is supported by the elongated body 14 at the first end 24 by a pin 30. The pin 30 defines the pivot axis B. The tool member 18 is configured to rotate about the pivot axis B relative to the elongated body 14. The locking member 22 is supported at the second end 26 of the elongated body 14. The illustrated locking member 22 includes a striking surface 34 that is configured to be impacted by a striking tool.

Figure 2:
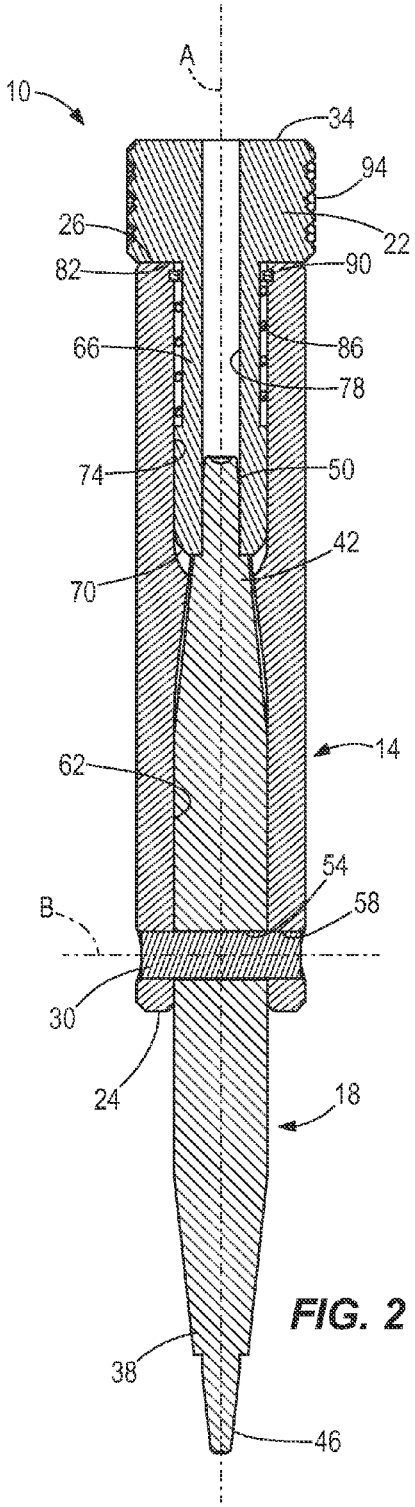
FIG. 2 is a cross-sectional view of the nail set of FIG. 1 taken along section line 2-2, the nail set including a locking member in a first position.
Figure 3:
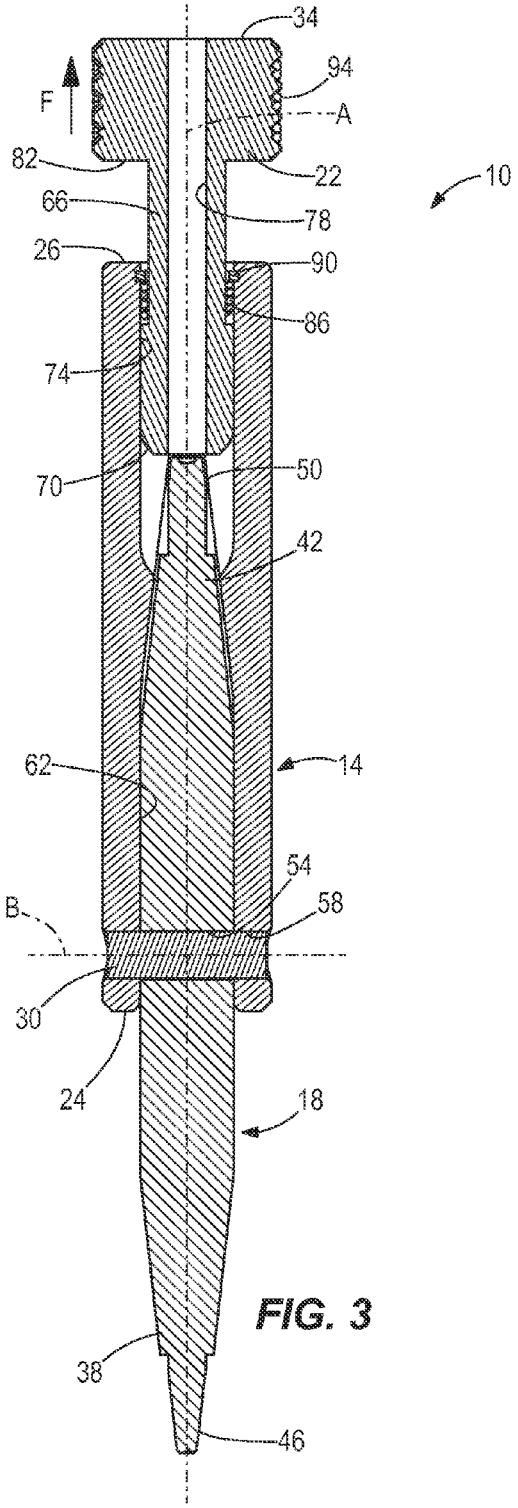
FIG. 3 is a cross-sectional view of the nail set of FIG. 1 taken along section line 2-2 with the locking member in a second position.

With reference to FIGS. 2-3, the tool member 18 includes a first end portion 38 and a second end portion 42. The first end portion 38 defines a first punch tool 46, and the second end portion 42 defines a second punch tool 50. The first punch tool 46 and the second punch tool 50 have different sizes or gauges. For example, the illustrated first punch tool 46 has a diameter of 1/32 inch, while the second punch tool 50 has a diameter of 3/32 inch. In the illustrated embodiment, the punch tools 46, 50 have circular cross-sections. In alternate embodiments, the first punch tool 46 and the second punch tool 50 may have square cross-sections or any other shaped cross-section, or the punch tools 46, 50 may each have a different cross-sectional shape. Additionally or alternatively, the punch tools 46, 50 may have different sizes.

The illustrated tool member 18 further defines a bore 54 that is positioned approximately equidistant between the first end portion 38 and the second end portion 42 of the tool member 18. The bore 54 is configured to receive the pin 30. Similarly, the elongated body 14 defines two apertures 58 located at the first end 24 of the elongated body 14. The apertures 58 are coaxial with the bore 54 along the pivot axis B. The apertures 58 are also configured to receive the pin 30 so that the tool member 18 is rotatable about the pivot axis B relative to elongated body 14. In alternate embodiments, the pin 30 may be replaced with a pair of projections that are integral to the tool member 18. In such embodiments, the projections may be received in the apertures 58. In further alternate embodiments, the pin 30 may be replaced with a pair of projections formed at the first distal end 24 of the elongated body 14. In such embodiments, the projections may be received within the pin bore 54 of the tool member 18 or alternatively within a pair of recesses formed in the tool member 18.

With continued reference to FIGS. 2-3, the elongated body 14 defines a tool slot 62. The tool slot 62 extends along the longitudinal axis A from the first end 24 toward the second end 26 of the elongated body 14. The tool slot 62 is configured to selectively receive either the first end portion 38 or the second end portion 42 of the tool member 18, as the tool member 18 is rotated about the pivot axis B. Similar to the elongated body 14, the tool member 18 has a longitudinal axis extending from the first end portion 38 to the second end portion 42. In the illustrated embodiment, the longitudinal axis of the tool member 18 is coaxial with the longitudinal axis A of the elongated body 14 when either the first end portion 38 or the second end portion 42 of the tool member 18 is received within the tool slot 62. When the first end portion 38 of the tool member 18 is received within the tool slot 62, the second end portion 42 of the tool member 18 extends outwardly from the first end 24 of the elongated body 14. In this position, the second punch tool 50 is exposed for engagement with a nail head. Similarly, when the second end portion 42 of the tool member 18 is received within the tool slot 62, the first end portion 38 of the tool member 18 extends outwardly from the first end 24 of the elongated body 14. In this position, the first punch tool 46 is exposed for engagement with a nail head.

With continued reference to FIGS. 2-3, the locking member 22 includes the striking surface 34 and a projection 66. In the illustrated embodiment, the locking member 22 is formed as an end cap that includes the striking surface 34. In the illustrated embodiment, the striking surface 34 and the projection 66 are integrally formed as a single member. In other embodiments, the striking surface 34 and the projection 66 may be separate members that are secured together. The illustrated projection 66 is a generally cylindrical shaft having a distal end 70 opposite from the striking surface 34. The shaft 66 extends from the striking surface 34 and into a channel 74 defined in the second end 26 of the elongated body 14. The channel 74 is coaxial with the longitudinal axis A of the elongated body 14 and in communication with the tool slot 62. The shaft 66 defines a tool bore 78 that is configured to receive either the first end portion 38 or the second end portion 42 of the tool member 18, depending on which portion 38, 42 is received within the tool slot 62.

The locking member 22 is linearly movable along the longitudinal axis A between a first, or locked, position (FIG. 2) and a second, or unlocked, position (FIG. 3). As shown in FIG. 2, when in the first position, the locking member 22 engages the tool member 18. More particularly, the shaft 66 receives either the first end portion 38 or the second end portion 42 of the tool member 18 within the tool bore 78 to retain the tool member 18 and inhibit rotation of the tool member 18 about the pivot axis B. Additionally, the locking member 22 defines a shoulder 82 that abuts the second end 26 of the elongated body 14 when the locking member 22 is in the first position. The shoulder 82 includes a surface formed on the locking member 22 that faces away from the striking surface 34.

As shown in FIG. 3, when in the second position, the locking member 22 disengages the tool member 18. More particularly, the shaft 66 is moved apart from the tool member 18 so that the punch tools 46, 50 are not received in the bore 78. In this position, the tool member 18 is rotatable relative to the elongated body 14 about the pivot axis B. When the locking member 22 is in the second position, the tool member 18 may be rotated about the pivot axis B so that either the first end portion 38 or the second end portion 42 is received within the tool slot 62, and the other end portion (and corresponding punch tool) extends outwardly from the first end 24 of the elongated body 14.

With reference to FIGS. 2-3, the illustrated nail set 10 further includes a spring 86. In the illustrated embodiment, the spring 86 is a coil spring, but other suitable biasing members may also or alternatively be employed. The spring 86 surrounds the cylindrical shaft 66 and is retained between the distal end 70 of the shaft 66 and a retaining ring 90. The retaining ring 90 is received within an associated circumferential groove formed on an inner surface of the elongated body 14 at the second end 26. As shown in FIG. 2, the spring 86 biases the locking member 22 to the first position. That is, the spring 86 biases the distal end 70 of the locking member 22 away from the second end 26 of the elongated body 14 and further into the bore 74.

In the illustrated embodiment, the locking member 22 includes a knurled outer surface 94. The knurled outer surface 94 extends between the striking surface 34 and the shaft 66, and forms a grip on the locking member 22. The knurled outer surface 94 facilitates manually grasping, or otherwise engaging, the locking member 22 to move the locking member 22 from the first position to the second position. In particular, the knurled outer surface 94 facilitates pulling the locking member 22 along the longitudinal axis A in a direction F (FIG. 3) against the bias of the spring 86 and away from the second end 26 of the elongated body 14.

In operation, the nail set 10 may be oriented such that either the first end portion 38 or the second end portion 42 of the tool member 18 extends outwardly from the elongated body 14. When the second end portion 42 of the tool member 18 is positioned within the tool slot 62 and the locking member 22 is in the first position (as shown in FIG. 2), the tool member 18 may be reoriented so that the first end portion 38 is retained within the tool slot 62, and the second end portion 42 extends from the first end 24 of the elongated body 14. To reorient the tool member 18, a user grasps the knurled outer surface 94 of the locking member 22 and pulls the locking member 22 in the direction F away from the elongated body 14 (as shown in FIG. 3). Pulling the locking member 22 along the longitudinal axis A moves the locking member 22 to the second position, in which the locking member 22 disengages the tool member 18. The user may then reorient the tool member 18 by rotating the tool member 18 about the pivot axis B so that the first end portion 38 is received within the tool slot 62 and the second end portion 42 extends from the first end 24 of the elongated body 14. The user then releases the locking member 22. When the locking member 22 is released, the spring 86 biases the locking member 22 back to the first position. In this position, the locking member 22 engages the first end portion 38 of the tool member 18 so that the first punch tool 46 is received within the tool bore 78, thereby inhibiting rotation of the tool member 18 about the pivot axis B.

A similar operation is carried out to reorient the tool member 18 so that the first end portion 38 extends from the first end 24 of the elongated body 14 and the second end portion 42 is retained within the tool slot 62.

When either the first end portion 38 or the second end portion 42 extends from the first end 24 of the elongated body 14 and the locking member 22 is in the first position, the first punch tool 46 or the second punch tool 50 may be engaged with a nail. In particular, the exposed punch tool 46, 50 may be placed in contact with a nail head to countersink the nail into a workpiece. Impacting the striking surface 34 with the striking tool transmits force through the locking member 22 to the tool member 18. The force is transmitted directly from the locking member 22 to the tool member 18 due to the direct abutment between the distal end 70 of the shaft 66 and the tool member 18. Additionally, some of the force may be transmitted from the locking member 22 to the tool member 18 through the elongated body 14 due to the direct abutment of the lip 82 with the second end 26 of the body 14 and the interface between the pin 30 and the tool member 18. The force is then transmitted from the tool member 18 into the nail, thereby driving the nail head downward into the workpiece and setting the nail head into the workpiece.

Figure 4:
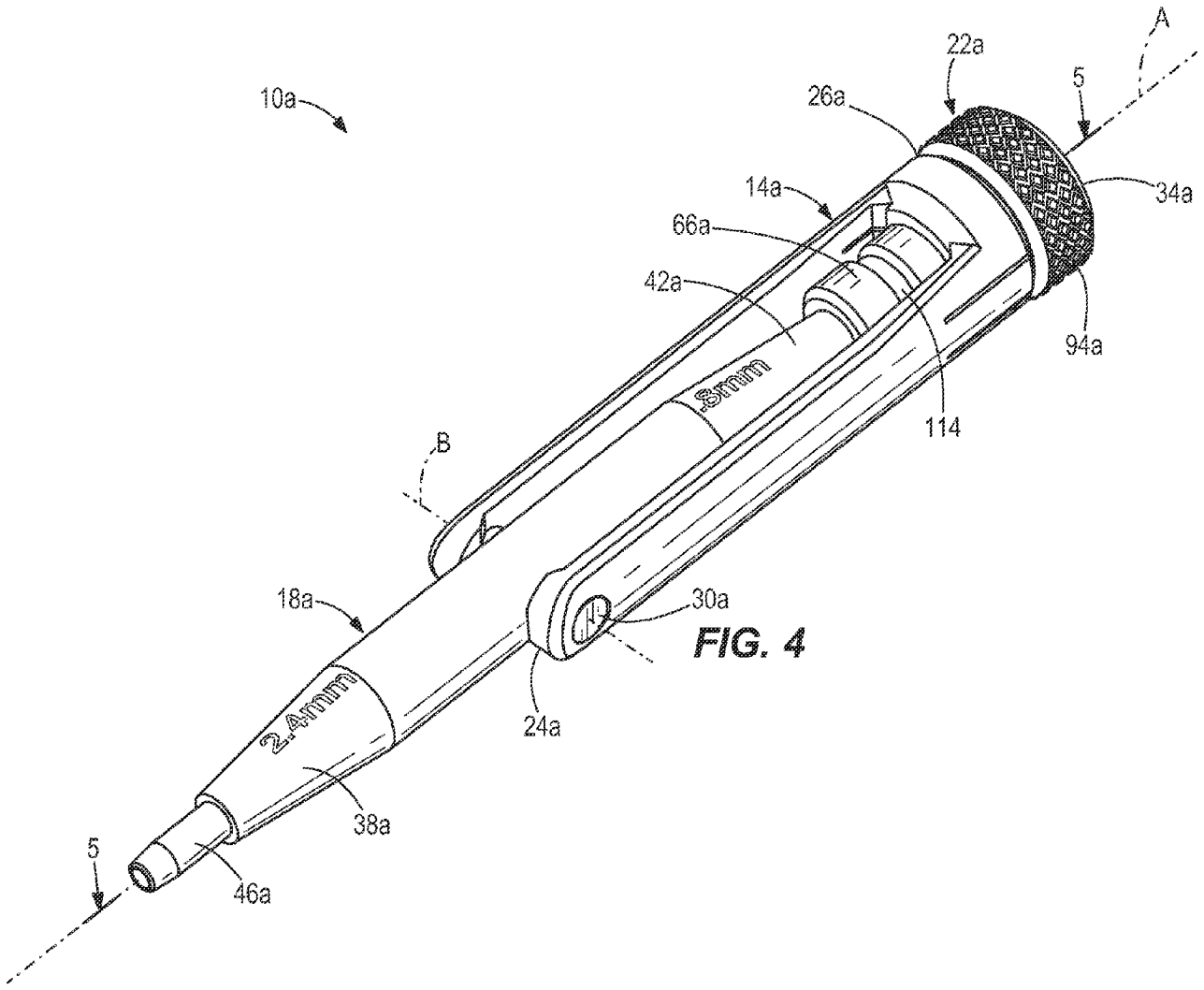
FIG. 4 is a perspective view of a nail set in accordance with another embodiment of the invention.
Figure 5:
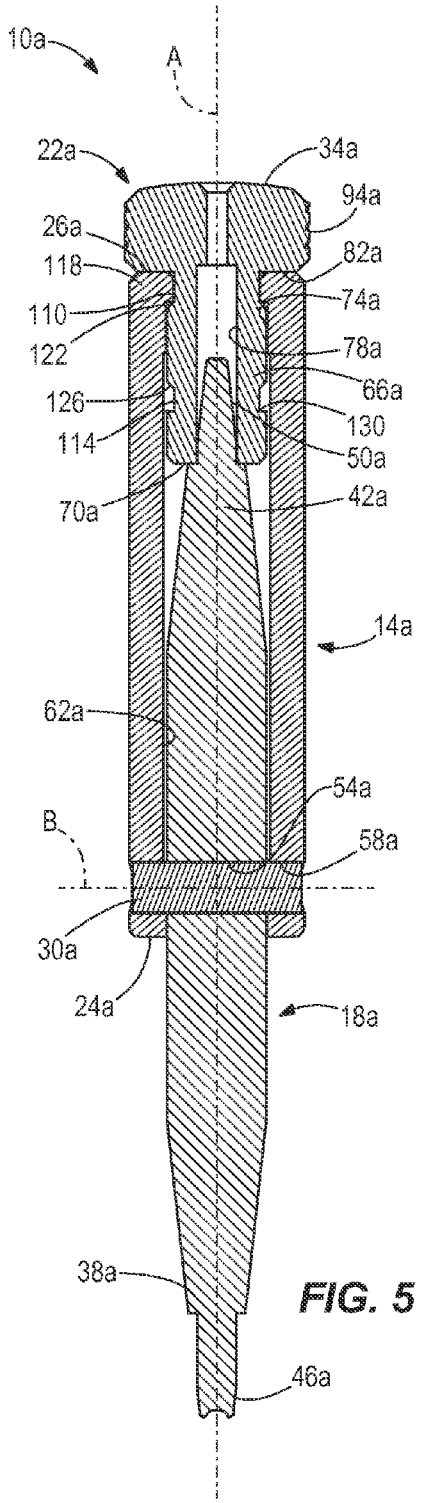
FIG. 5 is a cross-sectional view of the nail set of FIG. 4 taken along section line 5-5, the nail set including a locking member in a first position.
Figure 6:
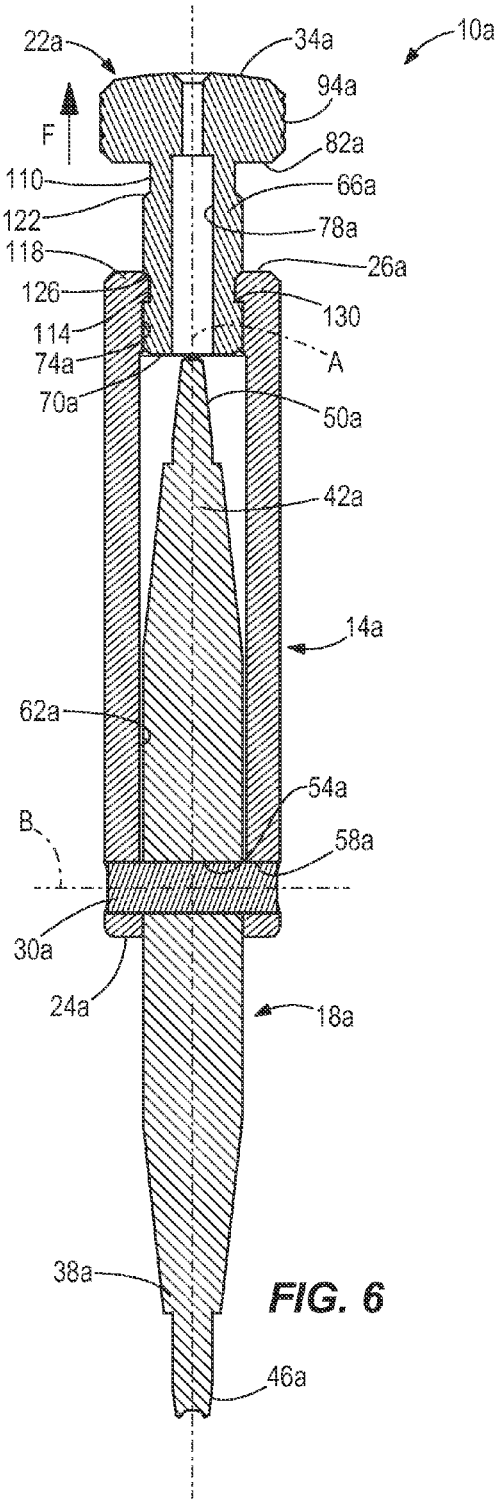
FIG. 6 is a cross-sectional view of the nail set of FIG. 4 taken along section line 5-5 with the locking member in a second position.

FIGS. 4-6 illustrate a nail set 10*a* in accordance with another embodiment of the invention. Like components and features are identified with like reference numerals plus the letter "a" and will not be described again in detail. With the exception of some minor distinctions in shape of some of the components, the elongated body 14*a* and the tool member 18*a* of the nail set 10*a* of FIGS. 4-6 are substantially identical to those features in the nail set 10 of FIGS. 1-3. The nail set 10*a* of FIGS. 4-6, however, does not include a compression spring 86 and a retaining ring 90 like the nail set 10 of FIGS. 1-3. Therefore, only the differences between the two embodiments will be described in detail.

With reference to FIGS. 5 and 6, the locking member 22*a* of the nail set 10*a* includes a first groove 110 circumferentially defined on the shaft 66*a* adjacent the lip 82*a* and a second groove 114 circumferentially defined on the cylindrical projection 66*a* adjacent the distal end 70*a* of the shaft 66*a*. The first groove 110 and the second groove 114 are both configured to receive a pair of detents 118 located at the second distal end 26*a* of the elongated body 14*a*. The detents 118 are formed on a pair of flexible members that are formed from the elongated body 14*a*. The first groove 110 has a first sloped wall 122. Similarly, the second groove 114 has a second sloped wall 126 and a perpendicular wall 130. The sloped walls 122, 126 allow the detents 118 to deflect out of the grooves 110, 114. The perpendicular wall 130 and the shoulder 82*a* inhibit movement of the detents out of the grooves 110, 114. In alternate embodiments, the first groove 110 and the second groove 114 are replaced with a first pair of recesses and a second pair of recesses that are each configured to receive the pair of the detents 118 to retain the locking member 22*a*.

As shown in FIG. 5, similar to the locking member 22 of FIGS. 1-3, the locking member 22*a* of FIGS. 4-6 is linearly movable between a first position (FIG. 5) and a second position (FIG. 6). In the first position, the locking member 22*a* of FIGS. 4-6 engages the tool member 18*a*. More particularly, the shaft 66*a* receives either the first end portion 38*a* or the second end portion 42*a* within the tool bore 78*a* to inhibit rotation of the tool member 18 about the pivot axis B. Additionally, in the first position the pair of detents 118 are received within the first groove 110 to retain the locking member 22*a* in the first position.

As shown in FIG. 6, when in the second position, the locking member 22*a* disengages the tool member 18*a*. More particularly, the shaft 66*a* is moved apart from the tool member 18 by pulling on the locking member 22*a* with sufficient force so that punch tools 46*a*, 50*a* are not received in the tool bore 78*a*. In this position, the tool member 18*a* is rotatable relative to the elongated body 14*a* about the pivot axis B. In the second position the pair of detents 118 are received within the second groove 114 to retain the locking member 22*a* in the second position (FIG. 6).

The first sloped wall 122 is configured to facilitate disengagement of the detents 118 from the first groove 110. More particularly, as the locking member 22*a* moves from the first position to the second position in a direction F away from the elongated body 14*a*, the detents 118 follow the first sloped wall 122, causing the pair of flexible members to bend away from the longitudinal axis A. As the flexible members deflect outwardly, the detents 118 are removed from the first groove 110 to allow the locking member 22*a* to be moved to the second position. Once in the second position, the flexible members spring back toward the longitudinal axis A, thereby biasing the detents 118 into the second groove 114 to retain the locking member 22*a* in the second position.

Similarly, the second sloped wall 126 is configured to facilitate disengagement of the pair of detents 118 from the second groove 114. More particularly, as the locking member 22*a* moves from the second position to the first position toward the elongated body 14*a*, the pair of detents 118 follow the second sloped wall 126, causing the pair of flexible members to bend away from the longitudinal axis A. As the flexible members deflect outwardly, the detents 118 are removed from the first groove 110 to allow the locking member 22*a* to be moved to the first position. The perpendicular wall 130 of the second groove is configured to retain the pair of detents 118 within the second groove 114 to inhibit removal of the locking member 22*a* entirely from the bore 70*a*. For example, while the locking member 22*a* is in the second position and if a user attempts to pull the locking member 22*a* in the direction F further away from the elongated body 14*a*, the detents 118 abut the perpendicular wall 130 to inhibit further axial movement of the locking member 22*a* along the longitudinal axis A.

In operation, the nail set 10*a* may be oriented such that either the first end portion 38*a* or the second end portion 42*a* of the tool member 18*a* extends outwardly from the elongated body. When the locking member 22*a* is in the first position and engaged with either the first end portion 38 or the second end portion 42 of the tool member 18*a* (similar to the nail set 10 of FIGS. 1-3), a user grasps the knurled outer surface 94*a* of the locking member 22*a* and pulls the locking member 22*a* in the direction F away from the elongated body 14*a*. Pulling the locking member 22*a* along the longitudinal axis A moves the locking member 22*a* toward the second position, in which the locking member 22*a* disengages the tool member 18. As the locking member 22*a* moves to the second position the detents 118 disengage from the first groove 110 via the first sloped wall 122. The detents 118 slide along the cylindrical projection 66*a* and are received within the second groove 114 to secure the locking member 22*a* in the second position (as shown in FIG. 6). Once the locking member 22*a* is secured in the second position, the tool member 18*a* may be rotated about the pivot axis B to reorient either the first end portion 38*a* or the second end portion 42*a* within the tool slot 62*a*.

To inhibit further rotation of the tool member 18*a*, the user moves the locking member 22*a* axially along the longitudinal axis A toward the elongated body 14*a* from the second position to the first position by pushing the locking member 22*a*. As the locking member 22*a* moves toward the first position, the detents 118 disengage from the second groove 114 via the second sloped wall 126 and slide along cylindrical projection 66*a* until the detents 118 are received within the first groove 110, securing the locking member 22*a* in the first position (FIG. 5). In the first position, the distal end 70*a* of the locking member 22*a* engages the tool member 18*a* so that the tool bore 78*a* receives either the first end portion 38*a* or the second end portion 42*a* to inhibit further rotation of the tool member 18*a* relative to the elongated body 14*a*.

Figure 7:
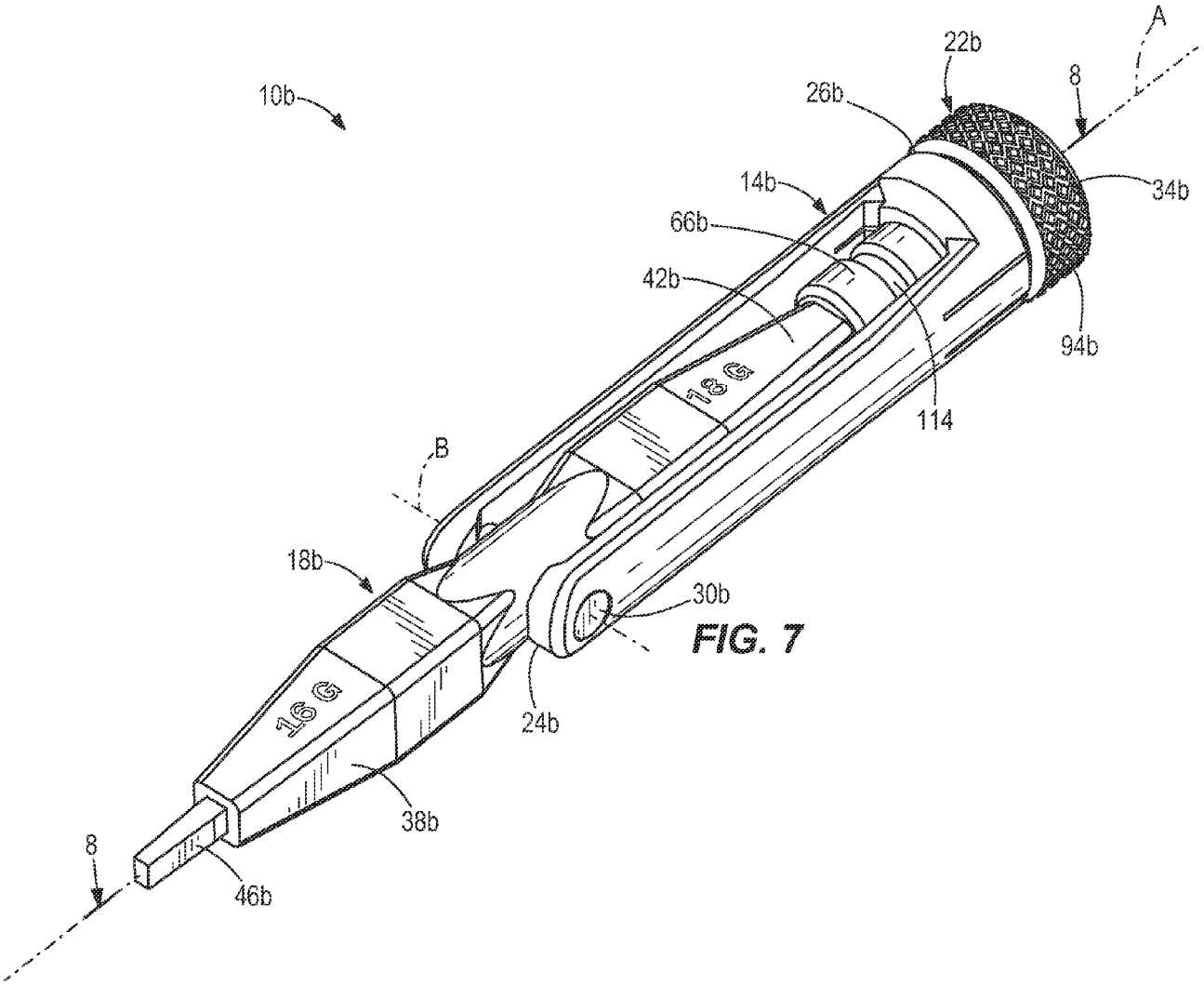
FIG. 7 is a perspective view of a nail set in accordance with another embodiment of the invention.
Figure 8:
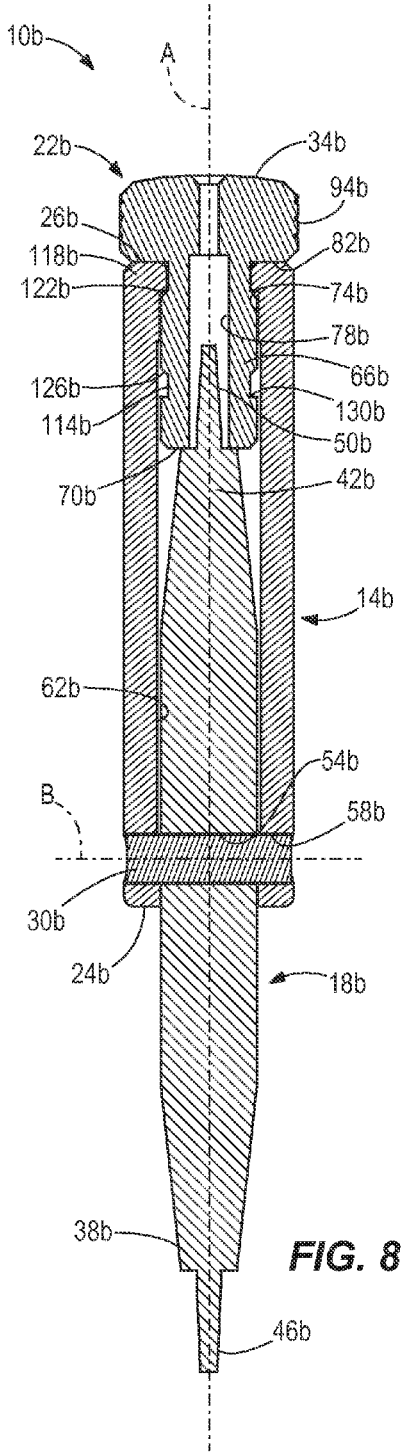
FIG. 8 is a cross-sectional view of the nail set of FIG. 7 taken along section line 8-8, the nail set including a locking member in a first position.
Figure 9:
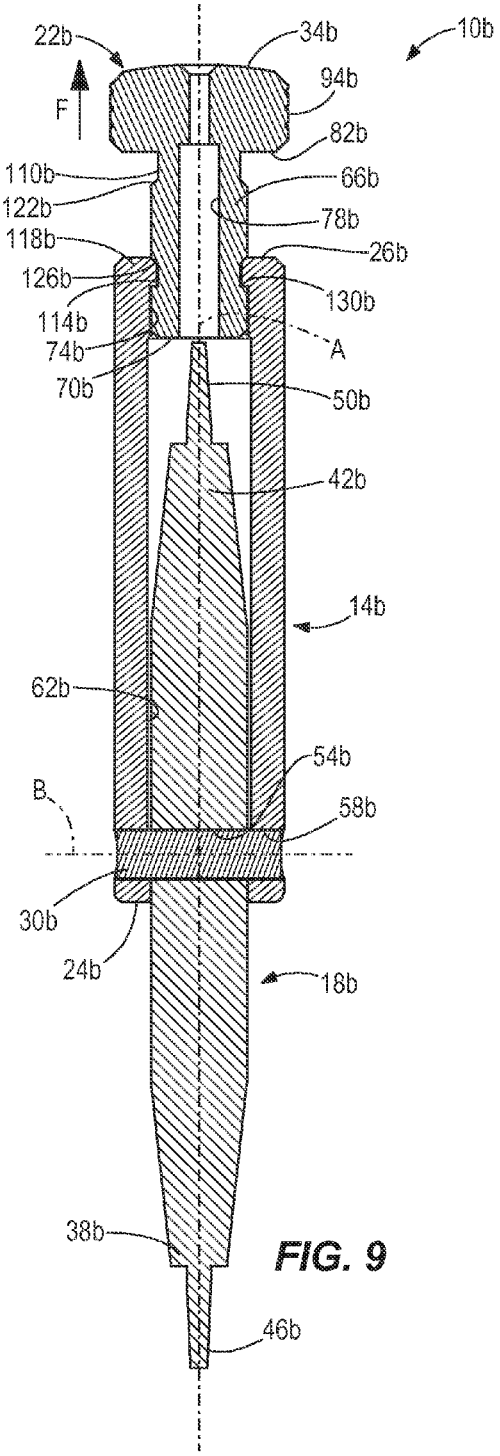
FIG. 9 is a cross-sectional view of the nail set of FIG. 7 taken along section line 8-8 with the locking member in a second position.

FIGS. 7-9 illustrate a nail set 10*b* in accordance with another embodiment of the invention. Like components and features are identified with like reference numerals plus the letter "b" and will not be described again in detail. With the exception of some minor distinctions in shape of some of the components, the nail set 10*b* of FIGS. 7-9 is otherwise identical to the nail set 10*a* of FIGS. 4-6. Specifically, the first punch tool 46*b* and the second punch tool 50*b* of the nail set 10*b* of FIGS. 7-9 have rectangular cross-sections opposed to the circular cross sections of the first punch tool 46*a* and the second punch tool 50*a* of the nail set 10*a* of FIG. 4-6. The manner of operation of the nail set 10*a* of FIGS. 4-6 is identical to that described above in connection with the nail set 10*a* of FIGS. 4-6.

Figure 10:
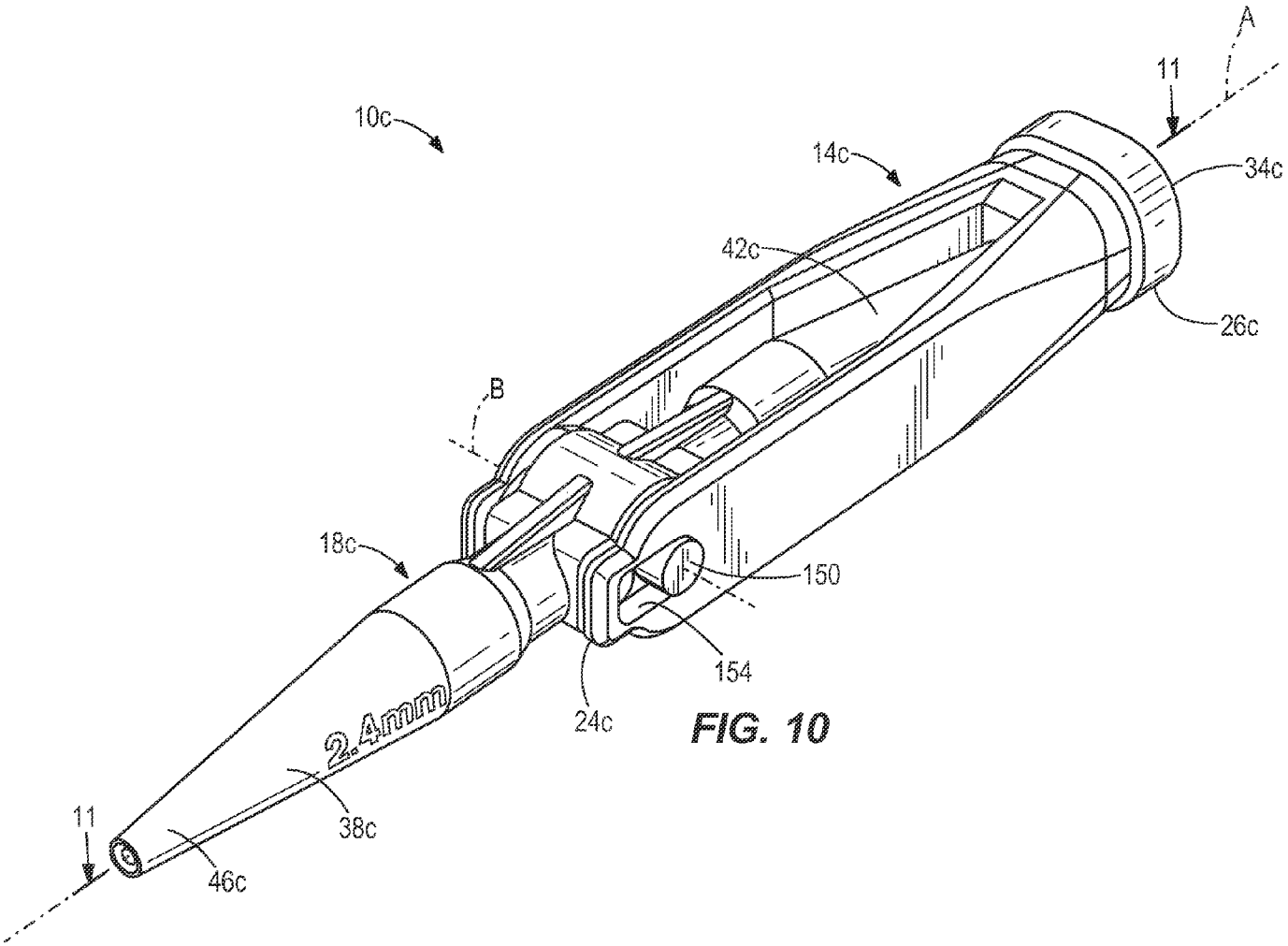
FIG. 10 is a perspective view of a nail set in accordance with another embodiment of the invention.
Figure 11:
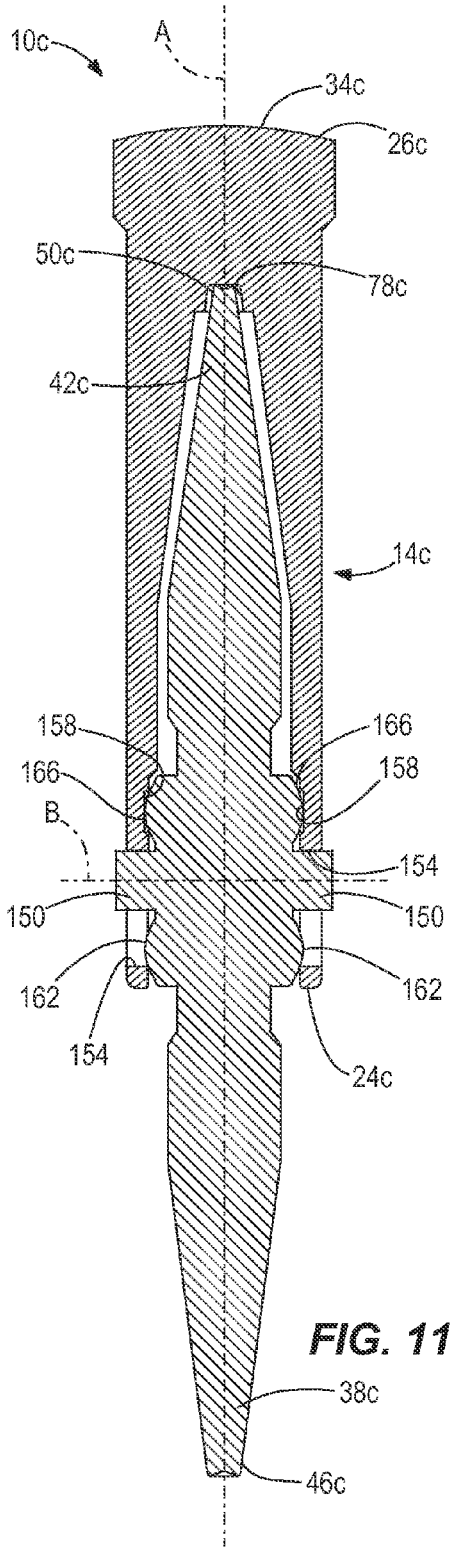
FIG. 11 is a cross-sectional view of the nail set of FIG. 10 taken along section line 11-11, the nail set including a tool member in a first position.
Figure 12:
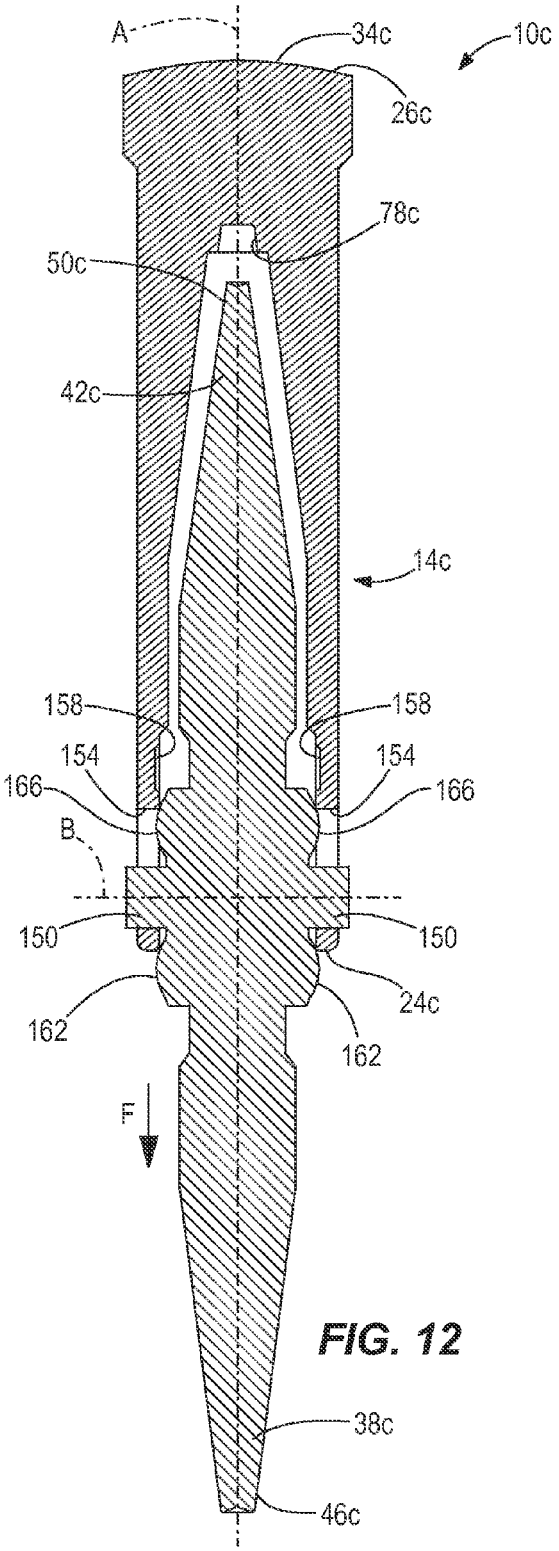
FIG. 12 is a cross-sectional view of the nail set of FIG. 10 taken along section line 11-11 with the tool member in a second position.

FIGS. 10-12 illustrate a nail set 10*c* in accordance with another embodiment of the invention. Like components and features are identified with like reference numerals plus the letter "c" and will not be described again in detail. In particular, the nail set 10*c* does not include a locking member that operates in a similar manner to the locking members shown in the embodiments of FIGS. 1-9.

With reference to FIG. 10, the tool member 18*c* of the nail set 10*c* includes a pair of pin-like projections 150, a pair of first detents 162, and a pair of second detents 166. The pin-like projections 150 define the pin axis B. The elongated body 14*c* further defines a pair of slots 154 located at the first end 24*c* of the elongated body 14*c* and a pair of detent recesses 158 (FIGS. 11 and 12) located within the tool slot 62*c* adjacent the tool slots 154. Additionally, the tool bore 78*c* is formed in the second end 26 of the elongated body 14*c*. The pin-like projections 150 are configured to be rotatably received within the slots 154. The pin-like projections 150 also slide within the slots 154 along the longitudinal axis A of the elongated body 14*c* between a first position (FIG. 11) and a second position (FIG. 12).

With reference to FIGS. 11-12, the first detents 162 are positioned between the pin-like projections 150 and the first end portion 38*c* along the longitudinal axis A. The second detents 166 are positioned between the pin-like projections 150 and the second end portion 42*c* along the longitudinal axis A. The first detents 162 and the second detents 166 are both configured to be selectively and alternatively received by the detent recesses 158. The detents 162, 166 form a locking member that selectively secures the tool member 18*c* in the first position. In alternate embodiments, the detents 162, 166 and the detent recesses 158 may be reversed so that detents on elongated body 14*c* are selectively received within recesses on the tool member 18*c* to secure the tool member 18*c* in the first position.

When in the first position (FIG. 11), either the first detents 162 or the second detents 166 are received in the detent recesses 158 to secure the tool member 18*c* from rotating about the pivot axis B. The tool member 18*c* is manually moved in a direction F away from the first distal end 24*c* of the elongated body 14*c* along the longitudinal axis A from the first position to the second position. When in the second position (FIG. 12), neither the first detents 162 nor the second detents 166 are received in detent recesses 158. In this position, the tool member 18*c* is free to rotate about the pivot axis B within the pair of slots 154.

Additionally, the tool bore 78*c* is configured to receive either the first end portion 38*c* or the second end portion 42*c* of the tool member 18*c* when the tool member 18*c* is in the first position to inhibit rotation of the tool member 18*c* about the pivot axis B and to transmit impact force from the striking surface 34*c* to the tool member 18*c*. In the second position, the tool member 18*c* is removable from the tool bore 78*c*. Additionally, the striking surface 34 is formed as an integral part of the elongated body 14*c* so that the striking surface 34 is located at the second distal end 26*c*.

In operation, the nail set 10*c* may be oriented such that the second punch tool 50*c* is received in the tool bore 78*c*, and the first end portion 38*c* extends outwardly from the elongated body 14*c*. Additionally, when the tool member 18*c* is in the first position, the second detents 166 are received by the detent recesses 158 to secure the tool member 18*c* relative to the elongated body 14*c*. When the second punch tool 50*c* is received in the tool bore 78*c* and the second detents 166 are received by the pair of detent recesses 158 (as shown in FIG. 11), the tool member 18*c* may be reoriented so that the first detents 162 are received by the detent recesses 158 and the first punch tool 46*c* is received within the tool bore 78*c*. To reorient the tool member 18*c*, the user grasps the first end portion 38*c* and pulls the tool member 18*c* in the direction F away from the first distal end 24*c* of the elongated body 14*c* (as shown in FIG. 12). Pulling the tool member 18*c* along the longitudinal axis A moves the tool member 18*c* to the second position, in which the second detents 166 disengage from the detent recesses 158 and the second punch tool 50*c* of the tool member 18*c* disengages from the tool bore 78*c*. The pin-like projections 150 slide within the slots 154 as the tool member 18*c* moves to the second position (FIG. 12). The user may then reorient the tool member 18*c* by rotating the tool member 18*c* about the pivot axis B so that the first end portion 38 is received within the tool slot 62*c* and the second end portion 42 extends from the first end 24*c* of the elongated body 14*c*. Once the first end portion 38*c* is received within the tool slot 62*c*, a user pushes the tool member 18*c* inwardly along the longitudinal axis A to the first position such the second end portion 42*c* extends from the first end 24*c* of the elongated body 14*c* and the first end portion 38*c* is received within the tool slot 62*c*, thereby inhibiting rotation of the tool member 18*c* about the pivot axis B. Additionally, the first detents 162 are received by the detent recesses 158 to secure the tool member 18*c* relative to the elongated body 14*c*.

A similar operation is carried out to reorient the tool member 18*c* so that the first end portion 38*c* extends from the first end 24*c* of the elongated body 14*c* and the second end portion 42*c* is secured within the tool slot 62*c*.

FIGS. 13-16 illustrate a nail set 10*d* in accordance with another embodiment of the invention. Like components and features are identified with like reference numerals plus the letter "d" and will not be described again in detail. With the exception of some minor distinctions in shape of some of the components, the elongated body 14*d* and the tool member 18*d* of the nail set 10*d* of FIGS. 13-16 are substantially identical to those features in the nail set 10 of FIGS. 1-3. The nail set 10*d* of FIGS. 13-16, however, does not include a compression spring 86 and a retaining ring 90 like the nail set 10 of FIGS. 1-3. Therefore, only the differences between the two embodiments will be described in detail.

Figure 13:
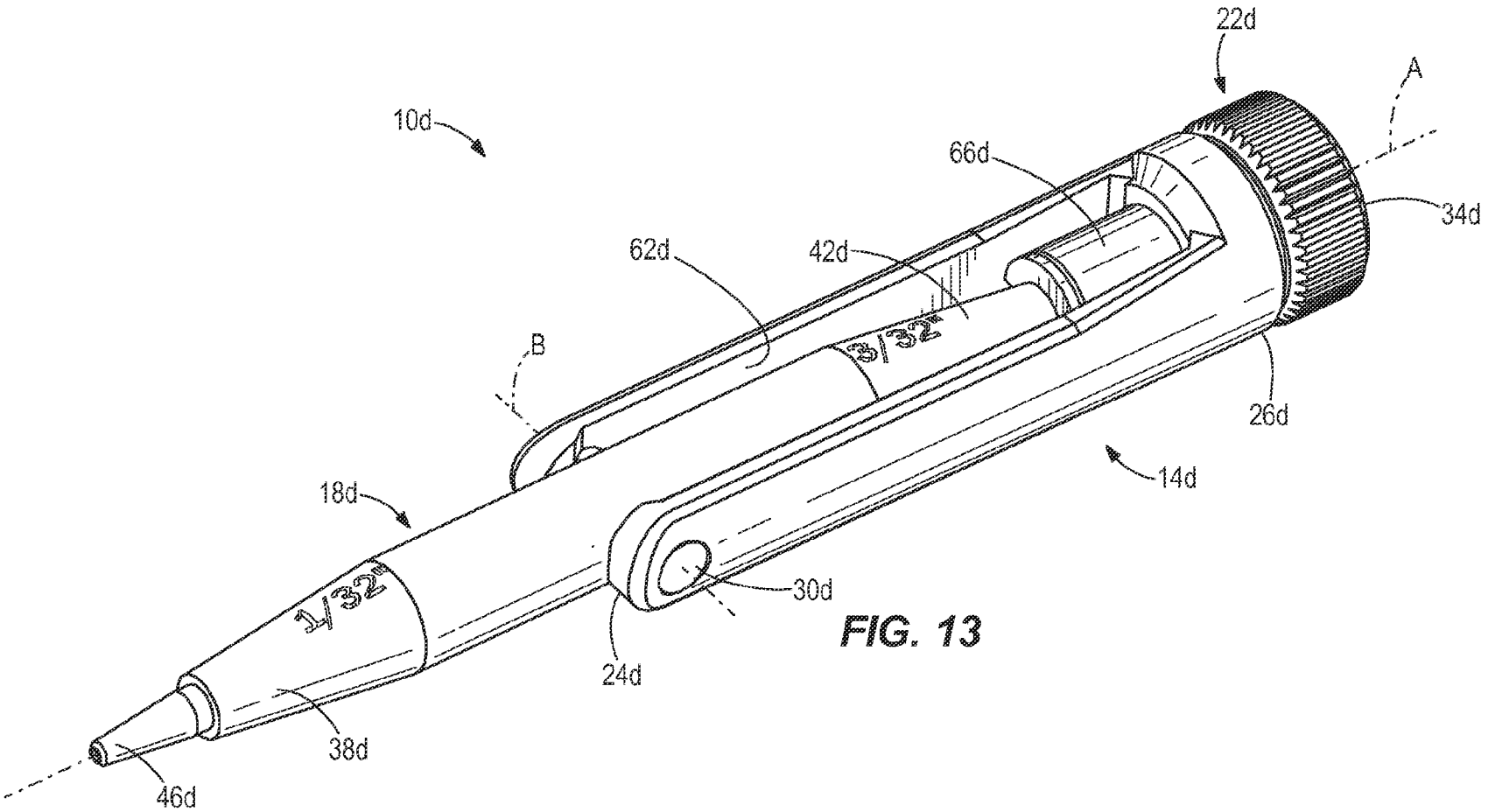
FIG. 13 is a perspective view of a nail set in accordance with another embodiment of the invention.
Figure 14:
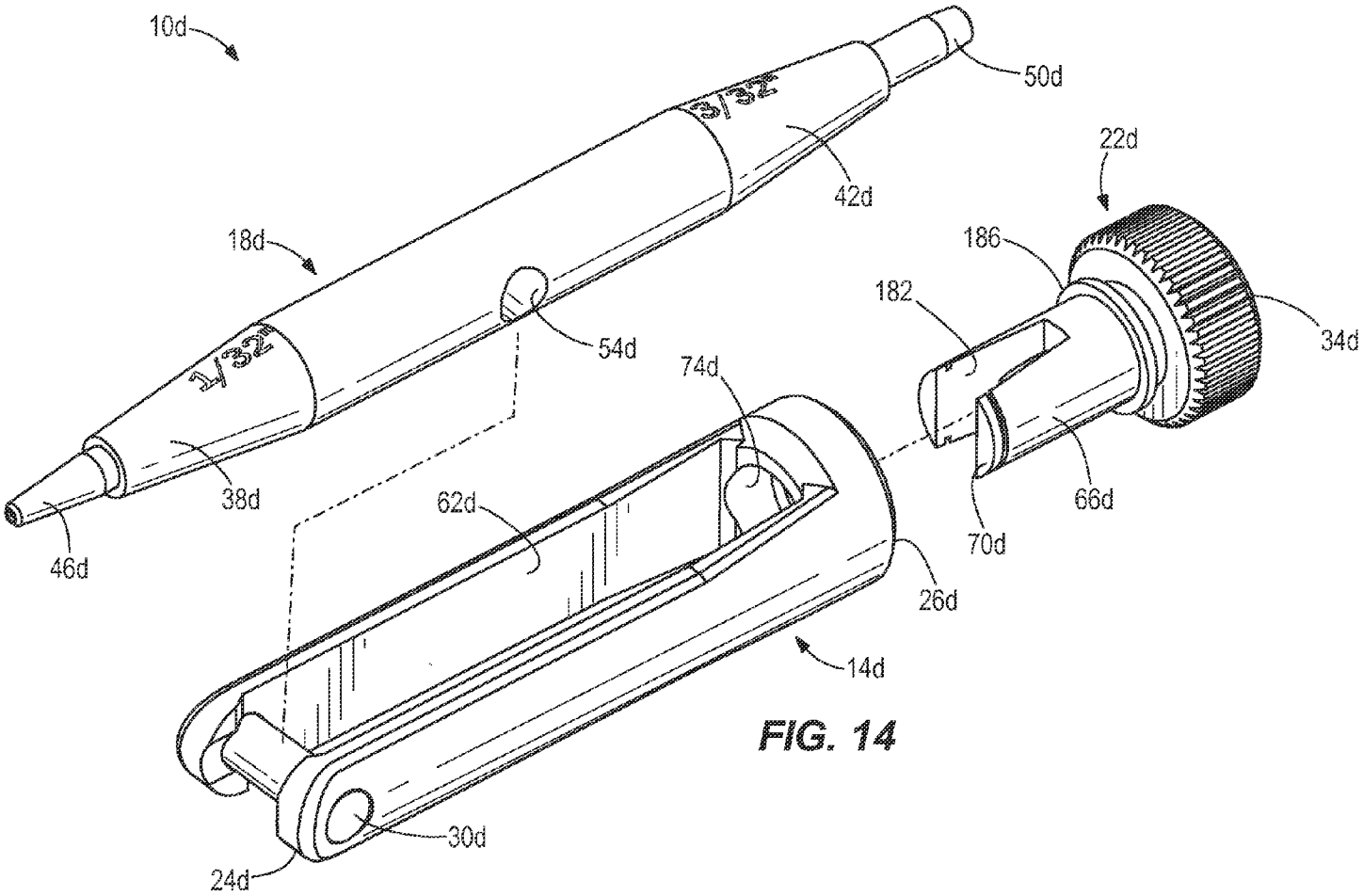
FIG. 14 is an exploded, perspective view of the nail set of FIG. 13.
Figure 16:
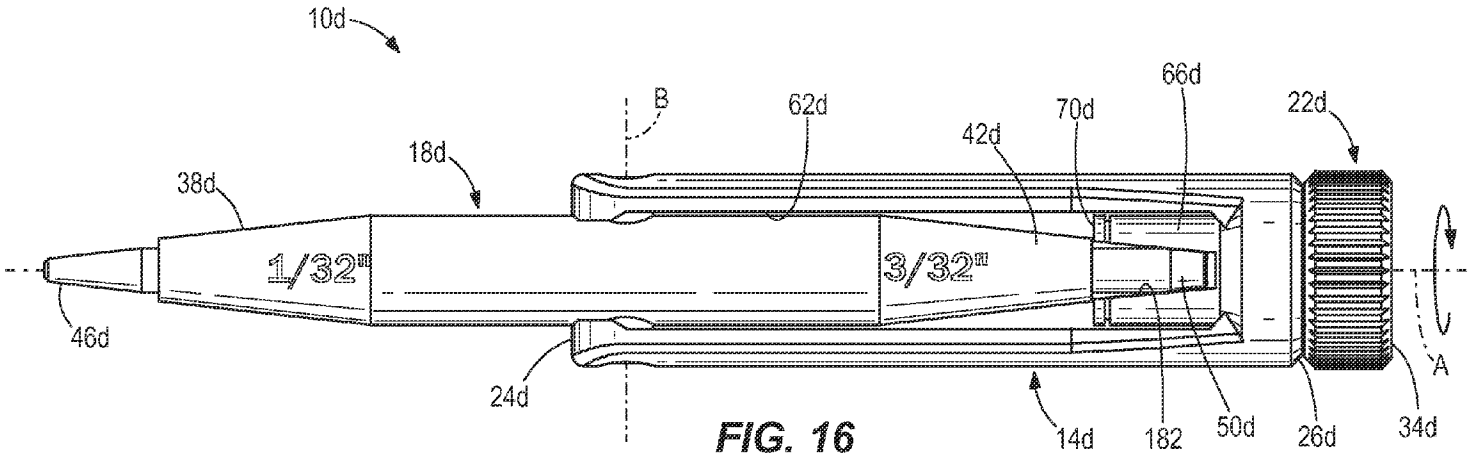
FIG. 16 is a side view of the nail set of FIG. 13 with the locking member in a second position

With reference to FIGS. 13 and 16, the shaft 66*d* of the locking member 22*d* of the nail set 10*d* defines a locking slot or channel 182 extending to the distal end 70*d* of the shaft 66*d*. The shaft 66*d* includes an annular protrusion 186 that corresponds with a groove (not shown) within the bore 74*d* of the elongated body 14*d*. The annular protrusion 186 is configured to be received within the groove, thus allowing the locking member 22*d* to rotate within the bore 74*d* of the elongated body 14*d* while inhibiting axial movement of the locking member 22*d* relative to the elongated body 14*d*. The locking channel 182 is configured to receive either the first punch tool 46*d* or the second punch tool 50*d* of the tool member 18*d*, depending on which portion 38*d*, 42*d* of the tool member 18*d* is received within the tool slot 62*d*.

Figure 15:
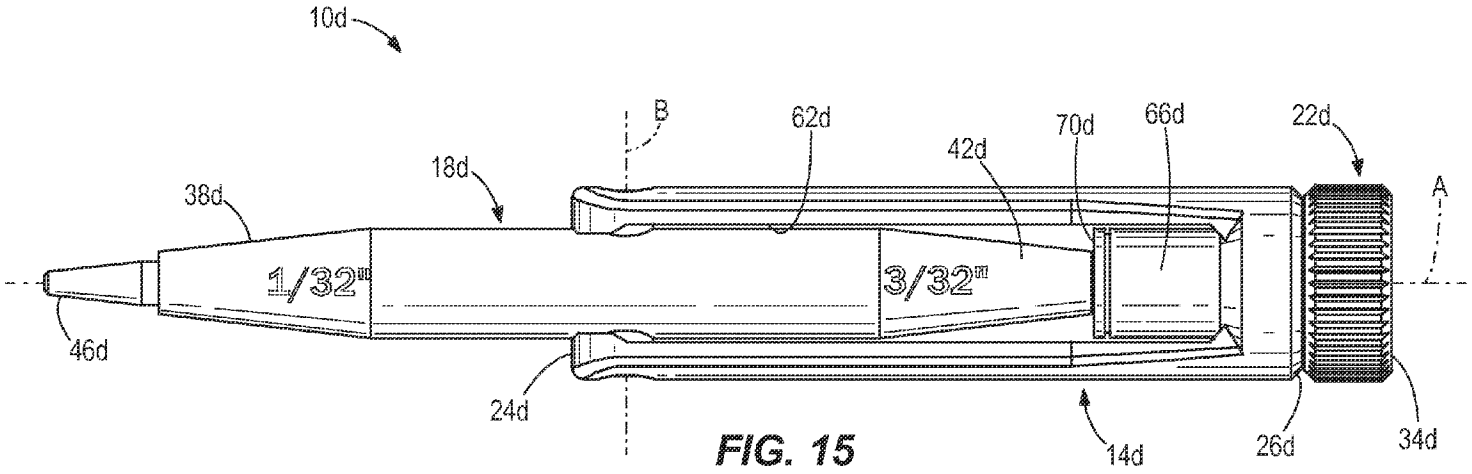
FIG. 15 is a side view of the nail set of FIG. 13, the nail set including a locking member in a first position.

The locking member 22*d* is rotatable about the longitudinal axis A between a first position (FIG. 15) and a second position (FIG. 16). In the illustrated embodiment, the first position and the second position are a quarter turn apart (i.e., 90 degrees). In other embodiments, the first and second positions may be a further distance apart (e.g., 180 degrees). As shown in FIG. 15, when in the first position, the locking member 22*d* engages the tool member 18. More particularly, the shaft 66*d* receives either the first end portion 38*d* or the second end portion 42*d* of the tool member 18 within the locking channel 182, and the locking channel 182 is misaligned with the tool slot 62*d* to retain the tool member 18*d* and inhibit rotation of the tool member 18*d* about the pivot axis B. In the illustrated embodiment, the locking channel 182 extends transversely to the longitudinal axis A and extends through the shaft 66*d*. Alternatively, the locking channel 182 may be a recess or multiple recesses that extend partially through the shaft 66*d*.

As shown in FIG. 16, when in the second position, the locking member 22*d* disengages the tool member 18*d*. More particularly, the locking member 22*d* and the shaft 66*d* are rotated relative to the elongated body 14*d* about the longitudinal axis A such that the locking channel 182 is aligned with the tool slot 62*d*. In this position, the tool member 18*d* is rotatable relative to the elongated body 14*d* about the pivot axis B. When the locking member 22*d* is in the second position, the tool member 18*d* may be rotated about the pivot axis so that either the first end portion 38*d* or the second end portion 42*d* is received within the tool slot 62*d*, and the other end portion (and corresponding punch tool) extends outwardly from the first end 24*d* of the elongated body 14*d*. In other words, in the second position, the tool member 18*d* may be rotated about the pivot axis B so that the punch tools 46*d*, 50*d* may pass freely through the locking channel 182 and tool slot 62*d*.

In operation, the nail set 10*d* may be oriented such that the first end portion 38*d* or the second end portion 42*d* of the tool member 18*d* extends outwardly from the elongated body 14*d*. When the second end portion 38*d* of the tool member 18*d* is positioned within the tool slot 62*d* and the locking member 22*d* is in the first position (as shown in FIG. 15), the tool member 18*d* may be reoriented so that the first end portion 38*d* is retained within the tool slot 62*d*, and the second end portion 42*d* extends from the first end 24*d* of the elongated body 14*d*. To reorient the tool member 18*d*, a user grasps the knurled outer surface 94*d* of the locking member 22*d* and rotates the locking member 22*d* in either direction about the longitudinal axis A of the elongated body 14*d* (as shown in FIG. 16). Rotating the locking member 22*d* a quarter turn about the longitudinal axis A rotates the locking member 22*d* to the second position, in which the locking channel 182 is aligned with the tool slot 62*d*. The user may then reorient the tool member 18*d* by rotating the tool member 18*d* about the pivot axis B so that the first end portion 38*d* is received within the tool slot 62*d* and the second end portion 42*d* extends from the first end 24*d* of the elongated body 14*d*. The user then rotates locking member 22*d* back to the first position. In this position, the first end portion 38*d* is received within the tool slot 62*d* and the locking member 22*d* is rotated such that the shaft 66*d* inhibits rotation of the tool member 18*d* about the pivot axis B.

A similar operation is carried out to reorient the tool member 18*d* such that the first end portion 38*d* extends from the first end 24*d* of the elongated body 14*d* and the second end portion 42*d* is retained within the tool slot 62*d*.

Figure 17:
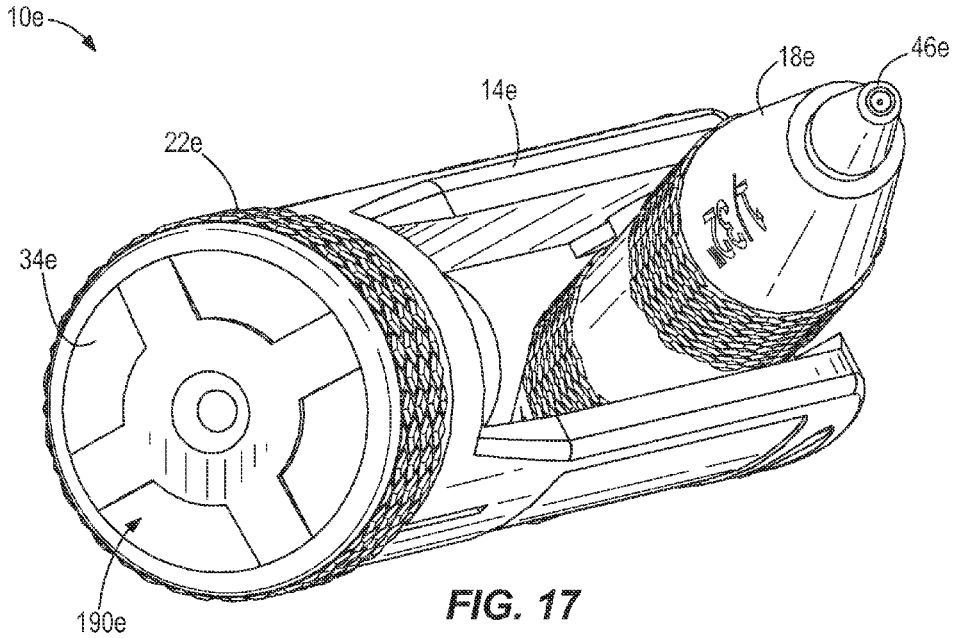
FIG. 17 is a perspective view of a nail set in accordance with another embodiment of the invention, the nail set including a punch tool with a round profile.
Figure 18:
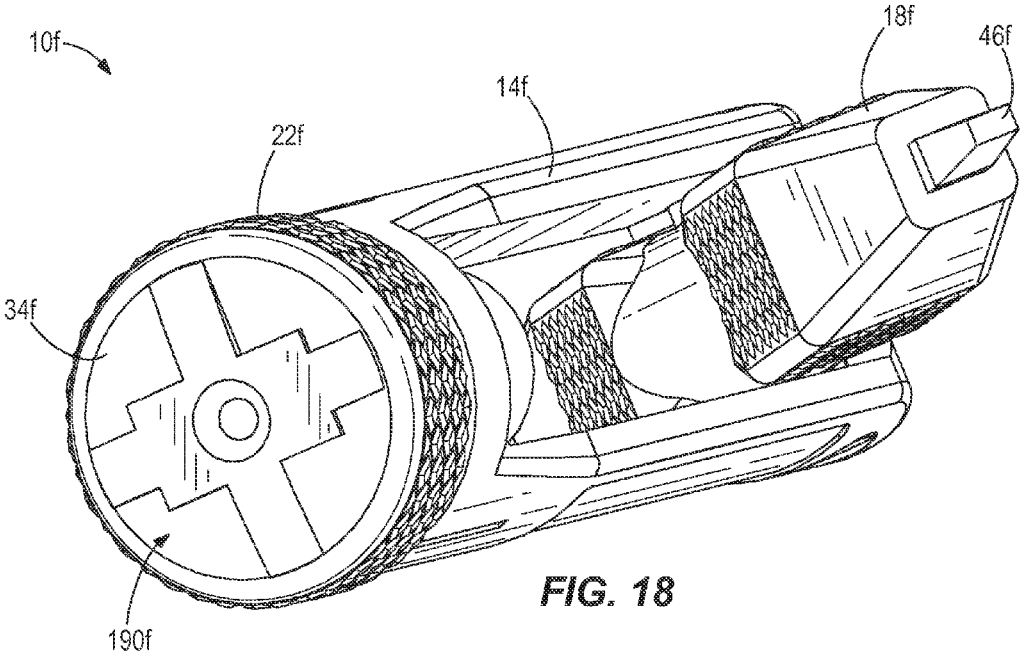
FIG. 18 is a perspective view of a nail set in accordance with yet another embodiment of the invention, the nail set including a punch tool with a rectangular profile.

FIGS. 17 and 18 illustrate nail set 10*e*, 10*f* in accordance with another embodiment of the invention. Like components and features are identified with like reference numerals plus the letter "e" or "f" and will not be described again in detail.

As noted above, the nail sets 10-10*d* can include punch tools 46, 50 of different geometrical cross-sections or profiles. FIG. 17 illustrates a nail set 10*e* that includes punch tools 46*e* with circular or round cross-sections. FIG. 18 illustrates a nail set 10*f* that includes punch tools 46*f* with rectangular or square cross-sections. To facilitate differentiating the geometrical profiles of the punch tools 46*e*, 46*f*, the nail sets 10*e*, 10*f* also include indicators 190*e*, 190*f*. In the illustrated embodiment, the indicators 190*e*, 190*f* are formed on the striking surfaces 34*e*, 34*f* of the locking members 22*e*, 22*f*. That is, the indicators 190*e*, 190*f* are formed on surfaces of the nail sets 10*e*, 10*f* that are visible when the nail sets 10*e*, 10*f* are in use. The indicators 190*e*, 190*f* are also visible if the nail sets 10*e*, 10*f* are stored in cubbyholes, racks, or shelves where the nail sets 10*e*, 10*f* are inserted punch-first. In other embodiments, the indicators 190*e*, 190*f* may be located elsewhere on the nail sets 10*e*, 10*f*.

In the illustrated embodiment, the indicators 190*e*, 190*f* are embossed patterns formed in the striking surfaces 34*e*, 34*f*. The patterns generally match the shape of the corresponding punch tools 46*e*, 46*f* For example, the embossed pattern shown in FIG. 17 includes a circle, which is the shape of the punch tool 46*e*. Similarly, the embossed pattern shown in FIG. 18 includes a rectangle, which is the shape of the punch tool 46*f* In other embodiments, other suitable indicators may also or alternatively be employed. For example, the indicators 190*e*, 190*f* may be debossed patterns formed in the striking surfaces 34*e*, 34*f*, pictures or images drawn on the striking surfaces 34*e*, 34*f*, and/or labels or stickers applied to the striking surfaces 34*e*, 34*f* In some embodiments, the indicators 190*e*, 190*f* may also include alphanumeric indicators. For example, the word "ROUND" or "SQUARE" and/or a number corresponding to the size (e.g., diameter, width, gauge, etc.) may be written or etched on the striking surfaces 34*e*, 34*f* In other embodiments, the indicators 190*e*, 190*f* may include a color or symbol associated with the particular cross-sectional shape or profile of each punch tool 34*e*, 34*f* These types of indicators 190*e*, 190*f* may be used with any of the nail sets 10-10*d* discussed above.

Although the invention has been described in detail with reference to certain preferred embodiments, variations and modifications exist within the scope and spirit of one or more independent aspects of the invention as described.

Various features of the invention are set forth in the following claims.

What is claimed is:

1. A nail set comprising:

an elongated body having a first end, a second end, a longitudinal axis and a pivot axis;

a tool member supported by the elongated body at the pivot axis, the tool member including a first end portion having a first punch tool and a second end portion having a second punch tool that is different from the first punch tool, the tool member being selectively rotatable about the pivot axis; and a locking member supported by the elongated body and including an outer surface forming a grip, the locking member movable between a first position, where the outer surface abuts the second end of the elongated body and the locking member engages the tool member to inhibit rotation of the tool member about the pivot axis, and a second position, where the outer surface is spaced apart from the second end of the elongated body and the tool member is rotatable relative to the elongated body about the pivot axis;

wherein the locking member includes a projection that extends into the elongated body, and wherein the projection engages the tool member when the locking member is in the first position, and is spaced apart from the tool member when the locking member is in the second position.

2. The nail set of claim 1, wherein the locking member is linearly movable along the longitudinal axis of the elongated body between the first position and the second position.

3. The nail set of claim 1, wherein the pivot axis is substantially perpendicular to the longitudinal axis of the elongated body.

4. The nail set of claim 1, wherein the elongated body further includes a tool slot that extends along the longitudinal axis of the body from the first end toward the second end, and wherein the tool member is at least partially received within the tool slot.

5. The nail set of claim 4, wherein the pivot axis is located at the first end of the elongated body.

6. The nail set of claim 1, further comprising a pin coupled to the elongated body and supporting the tool member, wherein the pin defines the pivot axis.

7. The nail set of claim 1, wherein the tool member has a longitudinal axis that is substantially coaxial with the longitudinal axis of the elongated body.

8. The nail set of claim 1, wherein the locking member includes a striking surface that is configured to be impacted by a tool.

9. The nail set of claim 1, further comprising a spring coupled to the elongated body and the locking member, wherein the spring biases the locking member toward the first position.

10. The nail set of claim 9, wherein the projection is a generally cylindrical shaft, and wherein the spring is wrapped around the generally cylindrical shaft.

11. The nail set of claim 1, wherein the locking member defines a bore that receives either first the punch tool or the second punch tool when the locking member is in the first position.

12. The nail set of claim 1, wherein either the locking member or the elongated body defines a first recess, and wherein the other of the locking member or the elongated body includes a detent that is received in the first recess to retain the locking member in the first position.

13. The nail set of claim 12, wherein either the locking member or the elongated body defines a second recess that is spaced apart from the first recess, and wherein the detent is received in the second recess to retain the locking member in the second position.

14. The nail set of claim 1, wherein the outer surface of the locking member includes a knurled outer surface.

15. A nail set comprising:

an elongated body having a longitudinal axis, a pivot axis, a first end, a second end, and a tool slot extending along the longitudinal axis from the first end toward the second end;

a pin coupled to the first end of the elongated body, the pin defining a pivot axis;

a tool member supported by the pin and at least partially received in the tool slot of the elongated body, the tool member including a first end portion having a first punch tool, and a second end portion having a second punch tool that is different than the first punch tool; and a locking member supported at the second end of the elongated body, the locking member including a striking surface that is movable relative to the elongated body and a generally cylindrical shaft extending into the elongated body, the locking member movable relative to the elongated body between a first position, where the generally cylindrical shaft engages the tool member to inhibit rotation of the tool member about the pivot axis, and a second position, where the generally cylindrical shaft is spaced apart from the tool member and the tool member is rotatable relative the elongated body about the pivot axis.

16. The nail set of claim 15, further comprising a spring coupled to the elongated body and the locking member, wherein the spring biases the locking member toward the first position.

17. The nail set of claim 15, wherein the generally cylindrical shaft defines a bore that receives either the first punch tool or the second punch tool when the locking member is in the first position.

* * * * *